US005713235A

United States Patent [19]

Diekhoff

[11] Patent Number: 5,713,235

[45] Date of Patent: Feb. 3, 1998

[54] METHOD AND APPARATUS FOR DIE NECKING A METAL CONTAINER

[75] Inventor: Hans H. Diekhoff, Avonmore, Pa.

[73] Assignee: Aluminum Company of America, Pittsburgh, Pa.

[21] Appl. No.: 705,487

[22] Filed: Aug. 29, 1996

[51] Int. Cl.[6] ..... B21D 22/00; B21D 22/21

[52] U.S. Cl. ..... 72/352; 72/348; 72/356; 413/69

[58] Field of Search ..... 72/348, 349, 352, 72/354.6, 356, 370.4, 344, 467; 413/69

[56] References Cited

U.S. PATENT DOCUMENTS

| | | | |
|---|---|---|---|
| 2,821,156 | 1/1958 | Lyon | 72/463 |
| 3,757,558 | 9/1973 | Heinle | 72/354 |
| 3,937,057 | 2/1976 | Saunders | 72/344 |
| 3,995,572 | 12/1976 | Saunders | 113/120 |
| 4,446,714 | 5/1984 | Cvacho | 72/348 |
| 4,519,232 | 5/1985 | Traczyk et al. | 72/133 |
| 4,527,412 | 7/1985 | Stoffel et al. | 72/349 |
| 4,693,108 | 9/1987 | Traczyk et al. | 72/370 |
| 4,732,027 | 3/1988 | Traczyk et al. | 72/133 |
| 4,753,364 | 6/1988 | Stoffel et al. | 220/75 |
| 4,774,839 | 10/1988 | Caleffi et al. | 72/354 |
| 5,355,710 | 10/1994 | Diekhoff | 72/379 |

*Primary Examiner*—Lowell A. Larson
*Assistant Examiner*—Rodney A. Butler
*Attorney, Agent, or Firm*—David W. Brownlee; E. L. Levine

[57] ABSTRACT

A method and apparatus for necking an open end of a metal container in which annular grooves are provided on the inner surface of the necking dies to abate sticking of cans in the dies during the necking process.

13 Claims, 5 Drawing Sheets

METHOD AND APPARATUS FOR DIE NECKING A METAL CONTAINER

BACKGROUND OF THE INVENTION

1. Field of the Invention

This invention relates to a method and apparatus for necking a metal container, such as a beverage container, to establish a necked-in area on the container.

2. Description of the Prior Art

It has been known with respect to beverage cans to provide an integrally formed bottom and a generally cylindrical body portion which terminates in an opening to which a separately formed can end may be secured. It has been known in respect of such containers to provide a reduced diameter portion adjacent the end to be opened to accommodate the application of a reduced diameter lid or closure on the container. The reduced diameter opening may receive an aerosol cap, screw cap or crown cap to permit access to the contents of the container open end.

It has also been known to provide multiple necked-in containers which have a plurality of circumferential ribs as taught by U.S. Pat. Nos. 3,995,572; 4,519,232; 4,693,018 and 4,732,027. U.S. Pat. No. 4,527,412 discloses a method for forming an aerosol container which has a domed restricted neck opening. According to that patent multiple forming steps create the dome on a welded tubular container. U.S. Pat. No. 4,774,839 discloses a method and apparatus for necking of container walls in a plurality of stages in order to produce a smooth neck configuration which has a straight angularly disposed necked-in portion separating curved portions between the neck, the cylindrical sidewall and an outwardly directed flange on the reduced diameter end of the container. U.S. Pat. No. 5,355,710 discloses several different modes for forming uniquely configured necked-in containers having curvilinearly curved sections.

A problem that sometimes arises in die necking metal cans, and especially cans made of thin gauge hard temper metal, which is die necked for two or more inches of can height, is that high friction between the necking tools and the necked in portion of the can may result in sticking of the can in the tools. It is sometimes difficult to strip from the can body the tools, and the can body may be damaged during forming and/or stripping. The portion of the can being necked is under compression by the die when the can is fully engaged in the die. The compressive forces between the die and the can may be greater than the stripping force of compressed air acting on the bottom of the can. The stripping air, which is introduced into the can during necking, acts against the bottom wall of the can 2–3 inches in diameter) and may not produce sufficient force to strip the can from the necking die.

A major contributing factor to the problem is long necked-in portion and extended contact between the internal die surface and the outer surface of the necked in portion. Other contributing factors include a possible build up of lubricant, smooth die and can surfaces, an outer flair of the can sidewall around the open end of the can, greater than usual sidewall thickness in the necked-in portion of the can, and possible necking defects.

U.S. Pat. No. 3,757,558 discloses apparatus for necking in tubular members wherein clearance is provided between the outer die and the inner die in order to reduce friction and compressive forces on the container walls and thereby resist scratches, scores and other defects in the resultant container product. Additionally, Stoffle Technologies, Inc., may have used necking dies having a single groove in them to reduce smudging of containers necked in accordance with U.S. Pat. No. 4,753,364.

Despite the foregoing known methods and apparatus, there remains a very real and substantial need for an improved method and apparatus for creating necked-in containers such as beverage containers which will operate with reduced friction and which will abate problems in stripping necked-in containers from the necking dies.

SUMMARY OF THE INVENTION

The present invention has met the above-described need by providing at least two annular die reliefs in the inner surface of necking dies. The method of this invention involves effecting generally radially inward deformation of an axial portion of a metal container body adjacent to an open end of the container to create an annular transition portion and a generally cylindrical reduced diameter portion. The invention preferably necks two or more inches of a container and may include 25 or more die necking operations or inward deformation stages to form a tapered transition portion and a cylindrical reduced diameter portion on a container. A preferred embodiment of this invention produces an aesthetically pleasing necked-in portion which includes a combination of smooth necking and stepped necking.

The apparatus of the present invention includes a plurality of die sets which establish a necked-in cylindrical portion and a generally frusto-conical portion connecting the cylindrical portion to the remainder of the can body. A die sleeve of this invention has a plurality of concentric grooves in its inner surface to reduce forming loads on can bodies which are necked with the die set. This invention reduces the inner surface area of the necking dies, provides lubrication pockets in the dies, reworks the leading edge of the container body to reduce outward flair of the edge, and reduces forming load required to neck container bodies.

It is an object of the present invention to provide a system for creating necked-in portions on metal containers through progressive deformation.

It is a further object of the present invention to provide such a system which is capable of necking cans at high production speeds with little or no sticking of the container bodies in the dies.

It is a further object of the present invention to provide a necked-in container which has improved compressive load characteristics.

It is a further object of this invention to provide such a system which establishes necked-in portions which are substantially devoid of undesired wrinkles.

It is yet another object of the present invention to provide such a system which may be employed in forming drawn and ironed beverage cans from relatively thin gauge, medium to hard temper aluminum container sheet.

It is another object of the present invention to provide a die-forming system which will provide a necked-in container having both desired functional properties and aesthetic appearance.

These and other objects of the present invention will be fully understood from the following description of the invention with reference to the drawings appended hereto.

DESCRIPTION OF THE PREFERRED EMBODIMENTS

Figure 1A:
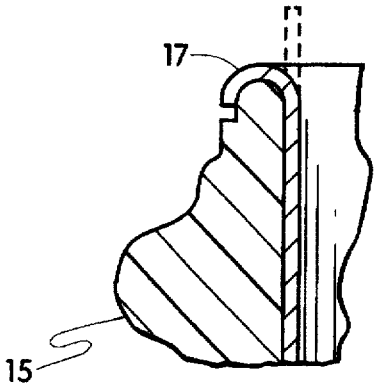
FIG. 1*a* is an enlarged cross-section of the circled portion of FIG. 1.
Figure 1:
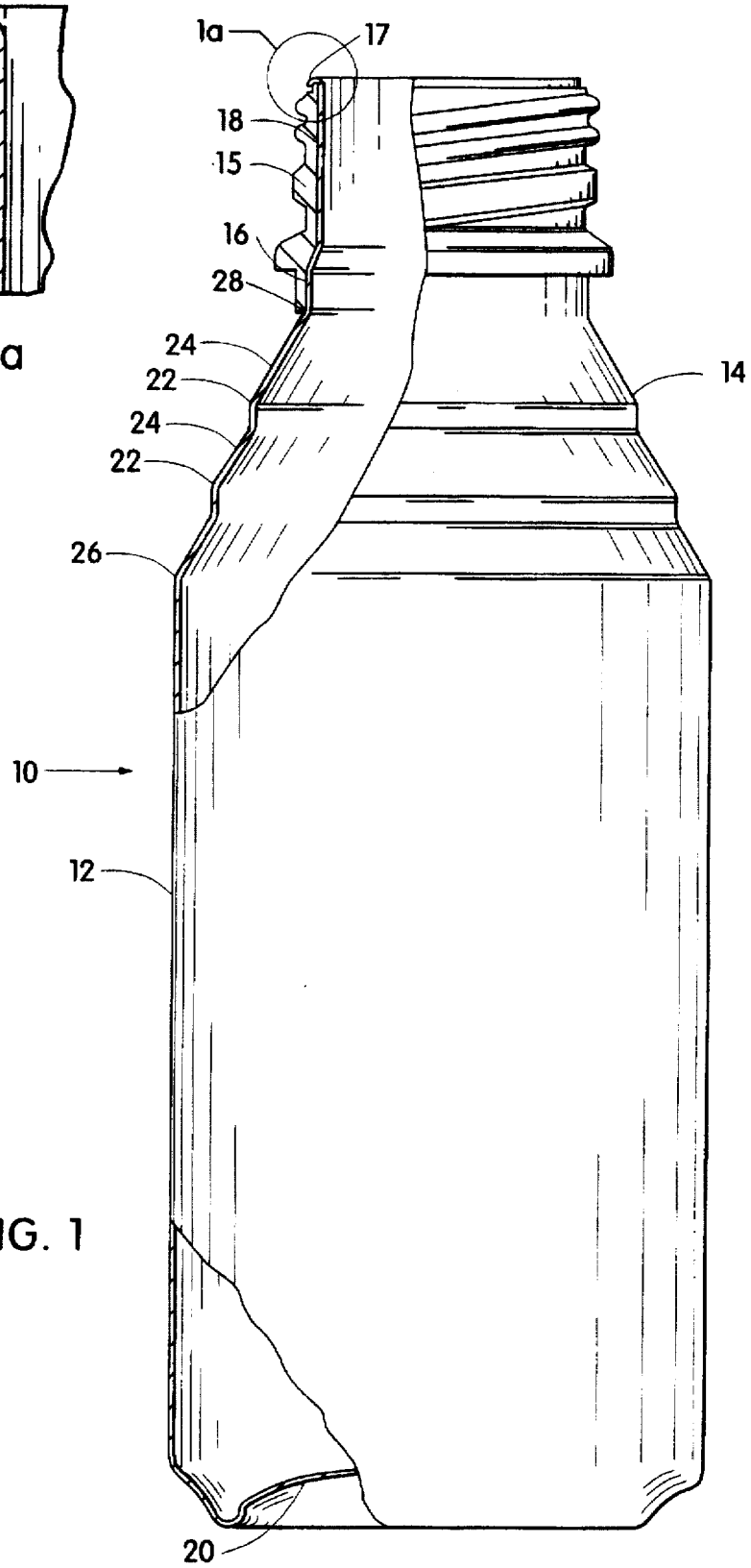
FIG. 1 is an elevational view, in partial fragmentary, of a container formed by the present invention.

Referring to FIG. 1, there is shown a container 10 having a generally cylindrical body 12 and upper end which includes a necked-in frusto-conical portion 14, a first cylindrical portion 16 of reduced diameter, a second cylindrical portion 18 of reduced diameter, and an integrally formed bottom wall 20. The container 10 is preferably an aluminum drawn and ironed container adapted for use with beverages and preferably has a threaded sleeve 15 secured on the portion 18 for securement of a threaded cap (not shown) on the container. Alternatively, integral threads could be formed in the cylindrical portion 18 as is illustrated and described in U.S. Pat. application Ser. No. 08/646,462, Filed May 8, 1996, the disclosure of which is incorporated by referenced into this application. The second cylindrical portion 18 has its upper edge 17 rolled or curled outwardly over the top of the sleeve 15 to secure the sleeve on the container. The transitional portion 14 on the container neck preferably has two or more circumferential curved portions or ribs 22 around it and generally frusto-conical straight portions 24 adjacent the curved ribs 22. The can 10 further has a curved radius 26 between the sidewall 12 and the neck and has a curved radius 28 between the transitional portion 14 and the first cylindrical portion 16.

Figure 2:
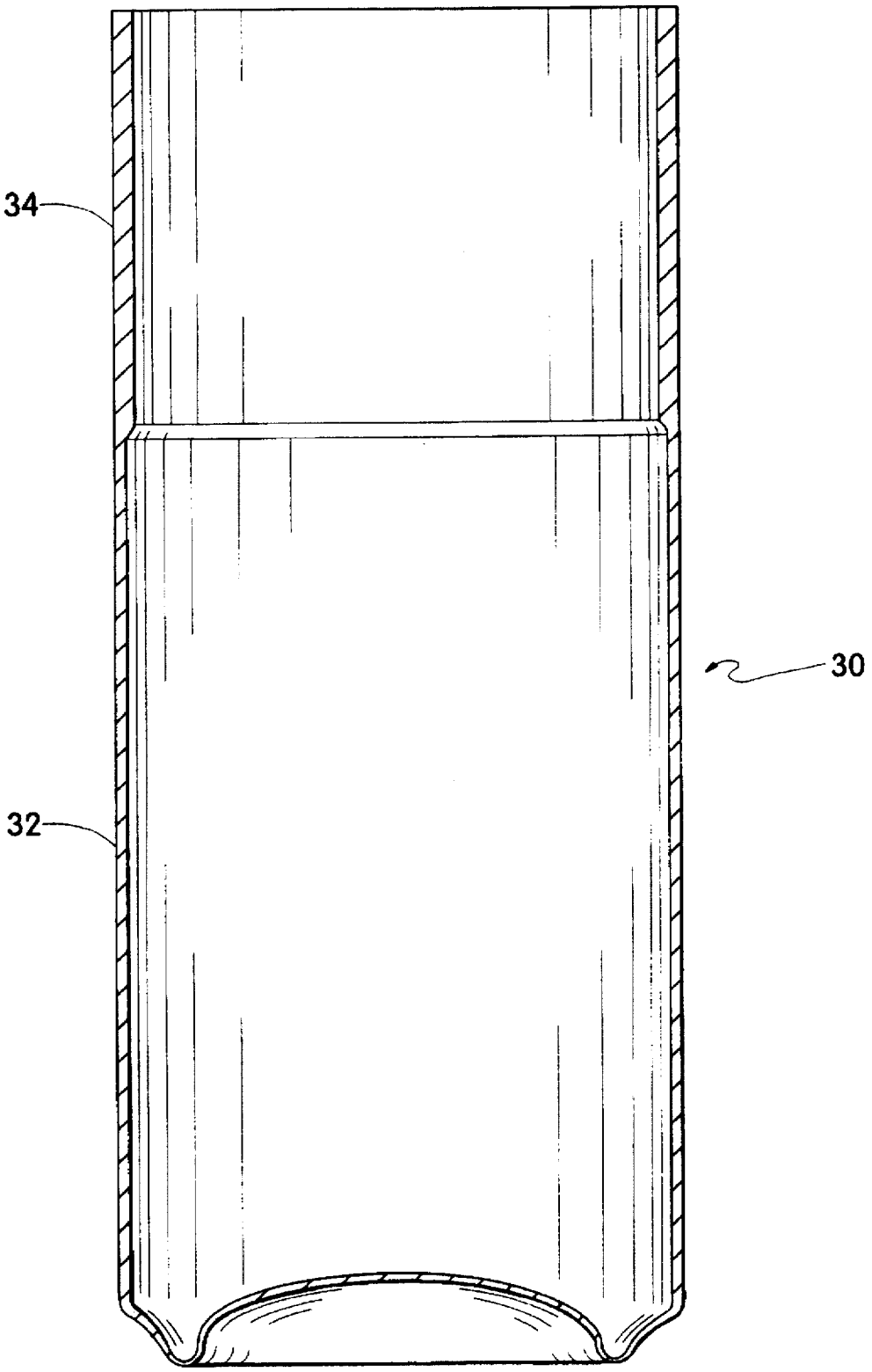
FIG. 2 is a cross-section of a container body which is adapted to be necked-in in accordance with this invention.

FIG. 2 shows a drawn and ironed can body 30 before it has been formed in accordance with this invention. This can 30 is made entirely of one piece of thin hard temper metal such as 3004, 3104, or 3204 H-19 aluminum alloy (Aluminum Association designations). The can body 30 before being necked is a preferably drawn and ironed (D&I) can body with a "thin wall" portion 32 and a top "thick wall" portion 34 adapted to be necked into the necked portion of the can. For purposes of illustration, the thickness of the metal is greatly exaggerated in this figure. The thick wall portion 34 is not ironed as much as, and is therefore thicker than the lower thin wall portion 32 of the sidewall. The thick wall top portion 34 is more formable into a necked-in portion since the thicker metal can be formed with less wrinkling or other undesirable deformation. The thick wall portion 34 of the can body 30 preferably commences at the corner between sidewall 12 and the top transitional portion 14 (FIG. 1). The thick wall portion 34 extends to the top of the can body which is the length of the necked portions 14, 16 and 18. A typical D&I can body used with this invention may have metal of about 0.0135inch in the bottom profile 20, a thickness of about 0.0055 inch in the thin wall portion 32, and a thickness about 0.0075 inch in the thick wall portion 34. Such can body may have a diameter of about 3 inches and a height of about 7⅜ inches to hold 20 fluid ounces or a height of about 8½ inches to hold 30 fluid ounces. Other D&I can bodies for use with this invention may have metal thickness of about 0.010 to 0.015 inch in the bottom profile 20, a thickness of about 0.0045 to 0.0065 inch in the thin wall portion 32 and a thickness of about 0.0065 to 0.0085 in the thick wall portion 34. Such cans may have diameters of about 2.5 inches to 3.5 inches and heights of about 5 inches to 10inches.

In accordance with this invention, a D&I can body is necked inwardly into a frusto-conical top portion by a method similar to that illustrated and described in U.S. Pat. No. 5,355,710, issued Oct. 17, 1994, the disclosure of which is incorporated by reference into this application. To form the necked-in portion shown on one-piece aluminum can of FIG. 1 requires at least 20, and preferably 25–30 necking operations in order to neck an aluminum can body having a diameter of approximately 3 inches down to a neck which is adapted to received a 38 mm closure. To form a neck on a 3 inch diameter can body to receive a larger or smaller closure would require more or fewer necking operations than are required for the smaller 38 mm closure. The generally frusto-Conical neck portion 14 preferably has a plurality of concavo-convex steps or ribs 22 in it, rather than have a straight frusto-conical neck. The steps 22 in the neck are believed to be aesthetically pleasing and minimize the appearance of any wrinkles that may form during the multiple necking operations. This effect is produced by a combination of necking as disclosed in U.S. Pat. No. 5,355,710 for producing a smooth or straight taper and the necking disclosed in U.S. Pat. Nos. 4,519,232; 4,693,018 and 4,732,072 which produces a plurality of circumferential ribs in the neck.

Figure 3:
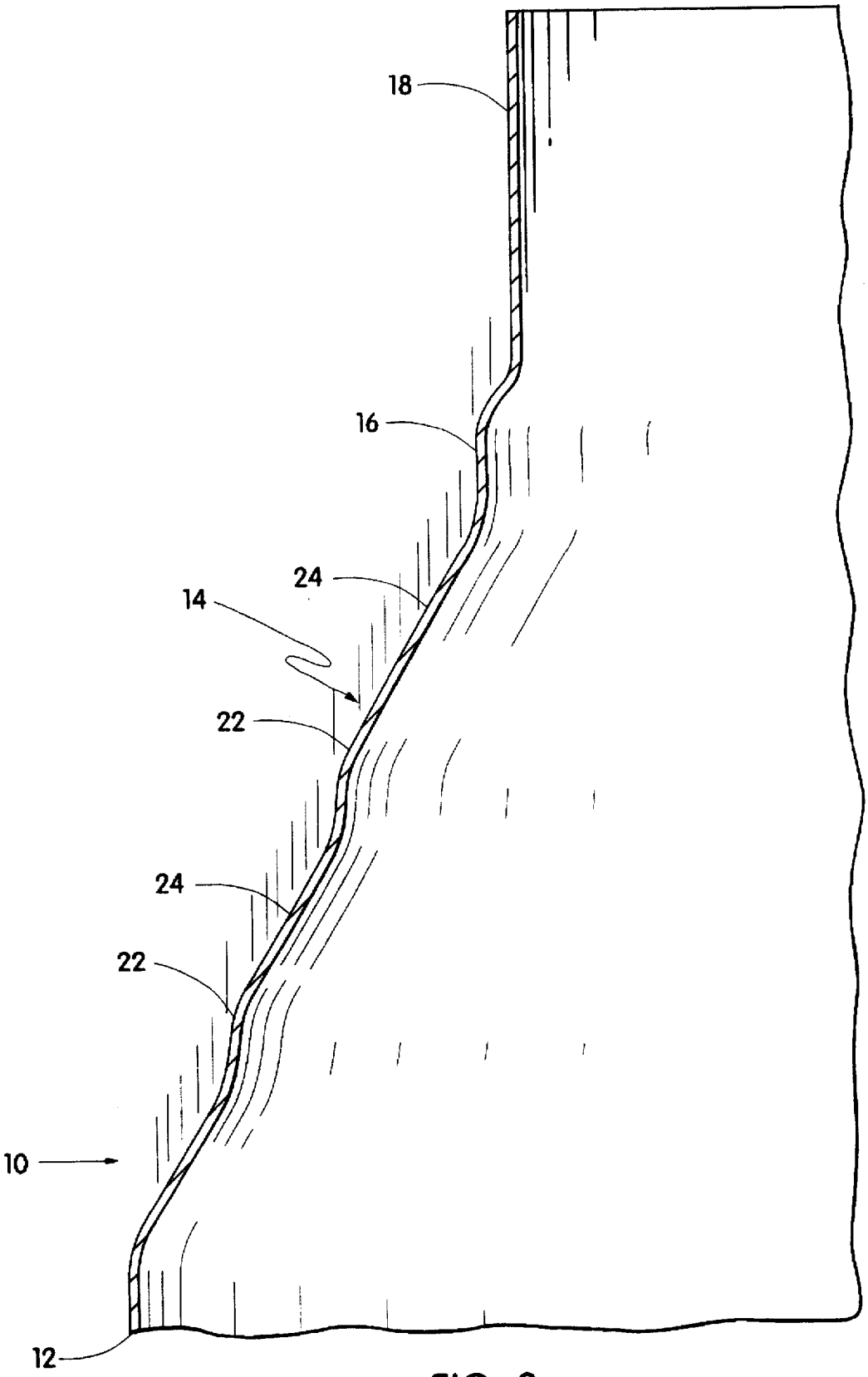
FIG. 3 is an enlarged, fragmentary, cross-sectional illustration of a necked-in section of a container formed by this invention.

FIG. 3 is an enlarged partial cross-section through the necked top transitional portion 14 and cylindrical portions 16, 18 of the can 10 prior to securing of a threaded sleeve on it or forming integral threads and a bead on such top portion. The left side of FIG. 3 shows the incremental reduction resulting from each of 27 necking operations used to form the portions 14, 16 and 18 on a $2^{11/16}$ inch (211) diameter can. In necking a can body made from hard temper aluminum alloy having a gauge thickness of approximately 0.0135 inch, the first necking reduction is preferably less than approximately 0.090 inch of the can diameter and that each of the subsequent reductions is preferably less than approximately 0.055 inch of the can diameter for a 3inch diameter (300) can and approximately 0.050 inch for a 211 can. In one example of the necking sequence for a 211 diameter can, the first reduction is preferably about 0.087 inch and each of the subsequent reductions is about 0.049–0.051 inch. In the practice of this invention, the metal thickness for larger diameter cans may be thicker than for smaller diameter cans to permit greater reductions in each necking operation.

Necking the top end of a can body in accordance with this invention results in a progressive thickening of the metal in the necked portion and therefore increased structural strength in the necked portion. The first and second cylindrical portions 16 and 18 are increased in thickness from an original thickness of approximately 0.0068 inch to a final thickness in a range of approximately 0.01050.0115inch for 211 diameter cans. For 300 diameter cans, the original thick wall may be about 0.0075 inch and the final thickness may be about 0.012 inch.

Figure 4:
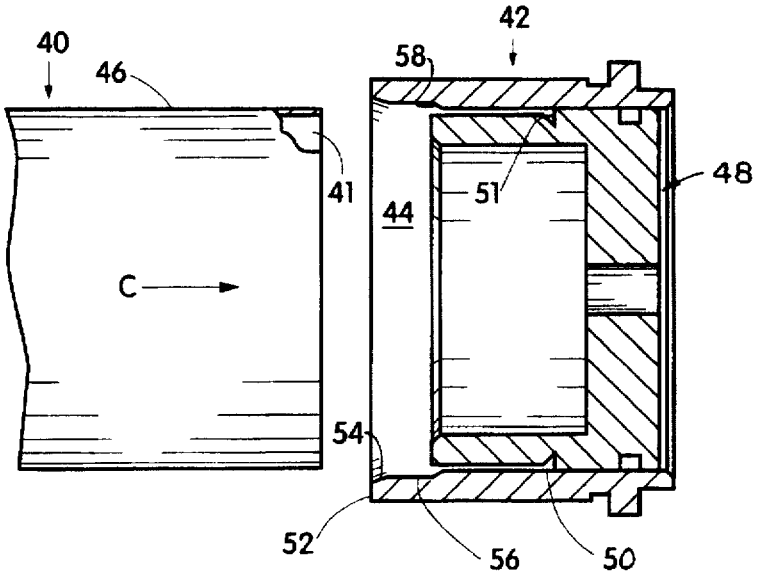
FIG. 4 is a cross-sectional illustration of dies employable in a preferred embodiment of the present invention.
Figure 5:
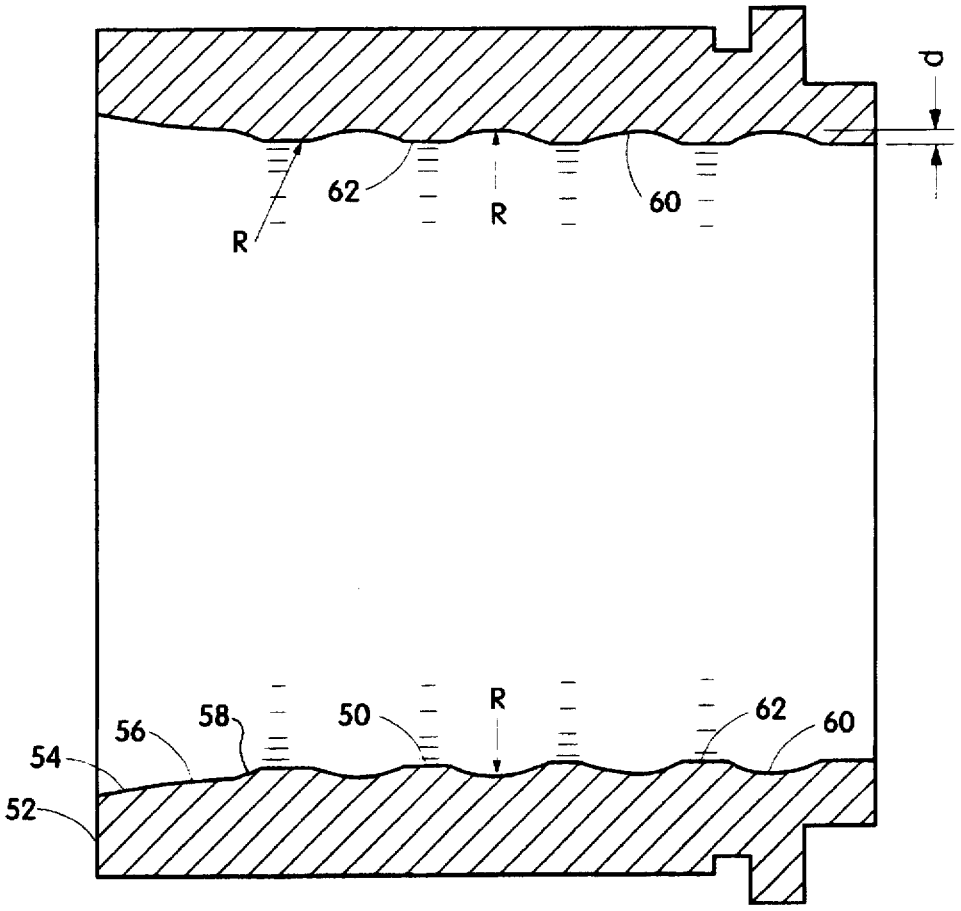
FIG. 5 is a cross-sectional illustration of the die sleeve of FIG. 4.

Referring to FIG. 4, a preferred die set employed to create a first reduction illustrated in FIG. 5 will be considered. Similar die sets are employed to create each of the other reductions. The dies may be made of tool steel, carbide or other ceramic materials which are able to withstand high loads such as approximately 400 pounds in necking cans at speeds of about 300 or more cans per minute. A D&I container 40 which has an opening 41 will be introduced into die sleeve 42. The die sleeve 42 has die cavity 44 within which is a knock-out 48. Relative closing movement is established between the container 40 and die 42 as by moving the container in the direction indicted by arrow C. Portion 46 of the container 40 will be circumferentially necked-in under the influence of a portion of interior surface 50 of die 42. Pressurized air or other gas is preferably injected into the container 40 as the container is moved into the die set to provide internal support for the container so it will not buckle or collapse under the column loading on the sidewalls of the container. The source of such pressurized air may be approximately 60 psi, but the container will see internal pressures less than that due to the dynamic nature of the operation. The knock-out 48, which may be reciprocated by conventional means, has an annular step 51 which engages the front of container 40. The knock-out moves the container 40 out of the die 42 after the container has been necked. The annular gap defined between the outer surface of knock-out 48 and the inner surface of die 42 receives the leading portion of container 40 and serves to minimize or eliminate wrinkling of the necked-in portion of the container.

Figure 6:
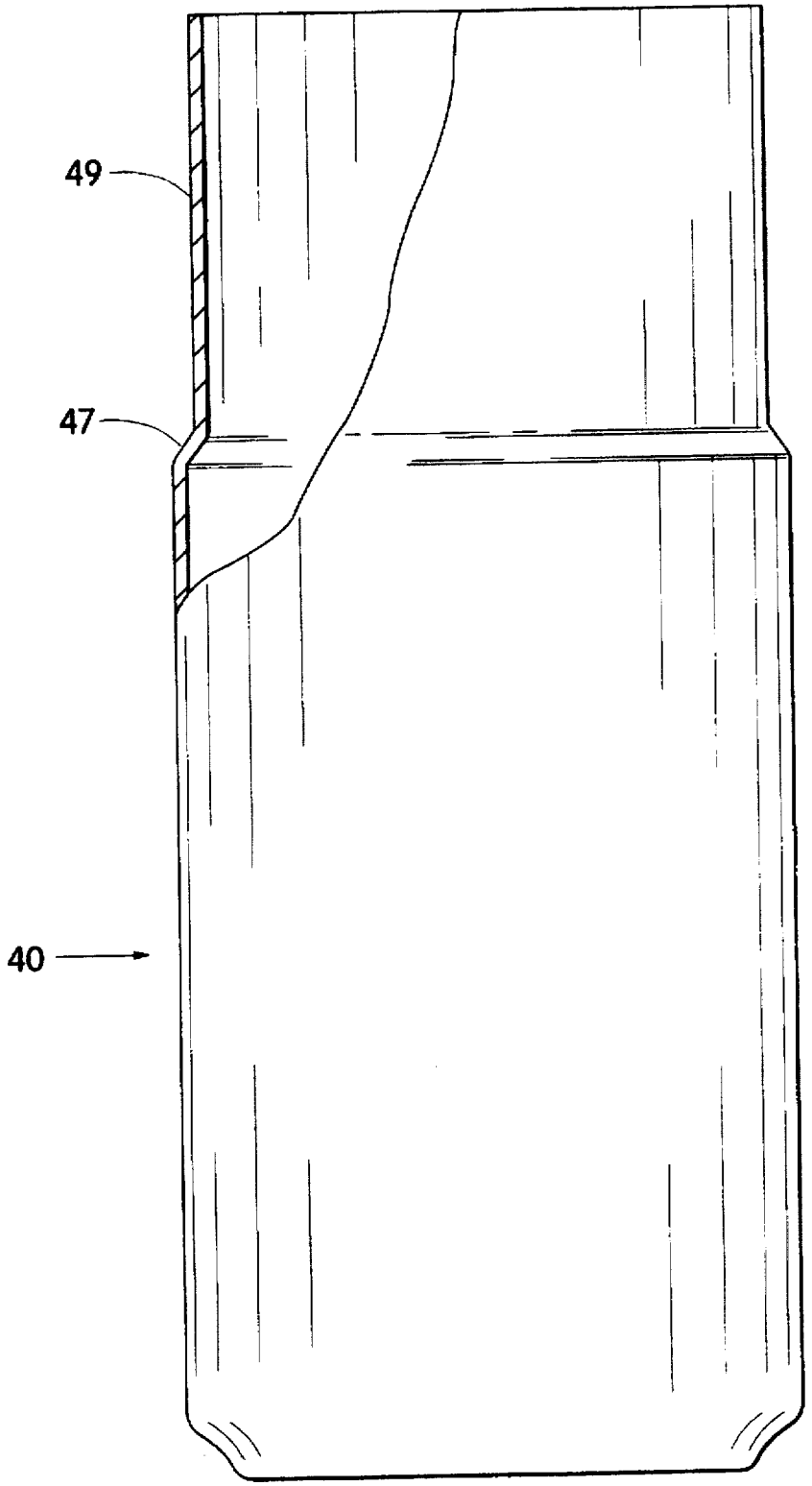
FIG. 6 is a cross-sectional view of a container body after first stage die necking.

The free end 52 of the die has an inner pilot surface 54, which will contact the leading edge of the container 40 in case it has some undesired ovality, and will urge it generally radially inwardly. If the cylindrical container does not have undesired ovality, the leading edge at opening 41 will initially contact die surface 56 which is of restricted diameter. Further movement causes the outwardly convex transition portion on die surface 58 to inwardly constrict or neck the leading edge of the portion 46 as it comes into contact with inner die surface 50. The net result of formation by this die will be the creation of the first stage reduction as shown in FIG. 6 in the form of an outwardly concave surface 47 by die surface 58 and the first stage of reduced diameter portion 49 by die surface 50. Similar dies and processing sequentially and progressively neck the can to form the neck as shown in FIG. 3.

It is a feature of this invention that inner surface 50 of the die 42 has at least two annular relief grooves 60 in it as illustrated in FIG. 5. The annular grooves 60 are shown in greatly exaggerated scale in FIG. 5 as they are in fact relatively shallow such as preferably about 0.002 to 0.006 inch deep "d" and more preferably about 0.004inch deep and about 0.310 inch wide. Each groove 60 preferably has an arcuate cross-sectional shape. The radius of curvature R or the arc is preferably relatively large, such as about 2–4 inches and more preferably about 3.00 inches. The grooves are preferably about 0.400 to 0.600 inch apart, center-to-center line, and more preferably about 0.500 inch apart. The inner surface of the die further has a generally cylindrical land 62 (flat in cross-section) between adjacent grooves 60. Each land 62 preferably has a width of about 0.15 to 0.25 inch and in one preferred embodiment has a width of about 0.19 inch. The grooves 60 and lands 62 preferably extend around the entire inner cylindrical surface 50 of the die. The corners between adjacent grooves 60 and lands 62 are rounded to provide a smooth transition therebetween. The finish on the inner surface of the die 42 including the grooves 60 and land 62 is preferably at least about 2–4 microinch (0.050–0.100 micrometer).

It has been found that the grooves 60 and lands 62 of this invention result in improved die performance by essentially eliminating sticking of can bodies in the dies and reduced forming loads. It is believed that this improved performance may be a result because the grooves reduce friction and surface tension and retain lubricant therein to facilitate relative movement between the dies and metal can bodies during die necking. For long die sleeves such as the first stage die shown in FIG. 5, three, four or more grooves, may be provided. For shorter dies such as the ones employed to form the last few stages of the container, two grooves may be optimum. There are several factors which affect the optimum number of grooves including length of the die, the percent reduction being taken, the metal thickness and hardness, and lubricant among others.

As stated above, the practice of this invention involves sequential die necking which may include as many as 27 or more separate reductions to produce a necked-in portion similar to that shown in FIGS. 1 and 3. The invention employs a series of progressive die sets like those shown in FIGS. 4 and 5 with each die set having slightly smaller diameters to progressively neck-in can bodies. The first die set in the progression is the longest to neck-in the full length of the necked-in portion. The die sets are progressively shorter to neck-in progressively shorter lengths of the neck.

It will be appreciated that the multi-stage forming process of this invention using dies having annular relief grooves in them effectively reduces forming loads and minimizes sticking of can bodies in the dies. It also minimizes wrinkling and other defects in the formed cans and produces enhanced, smoother finishes on the necked-in portions.

Whereas particular preferred embodiments have been described for purposes of illustration, it will be evident to those skilled in the art that numerous variations in details may be made without departing from the invention or the claims appended hereto.

What is claimed is:

1. In a method of necking an end portion of the sidewall of a metal can body by engaging the external surface of an axial portion of the sidewall of a can body adjacent to an open end of the can body with a necking die to deform such axial portion radially inward to establish a generally cylindrical reduced diameter portion adjacent to said open end and a transition portion between said reduced diameter portion and the undeformed underlying body portion of the can body, the improvement comprising:

providing at least two annular relief grooves in the inner surface of said necking die, said grooves each having a depth of at least about 0.004 to 0.006 inch, and a width of about 0.220 to 0.380 inch, and having a generally cylindrical land about 0.10 to 0.30 inch wide between the grooves.

2. A method as set forth in claim 1 in which said necking die includes at least three said relief grooves.

3. A method as set forth in claim 1 which includes engaging the sidewall of said can body with a series of at least 20 necking dies to progressively neck the sidewall of the can body.

4. A method as set forth in claim 1 in which each said relief groove has an arcuate inner surface with a radius of about 2–4 inches.

5. A method for forming a metal can body having a reduced diameter cylindrical portion and a generally frustoconical transitional portion connecting said reduced diameter cylindrical portion to the sidewall of the can by die necking said can body in at least 20 stages to progressively reduce the diameter of an end portion of the can body comprising engaging the open end of the can body with a first die to reduce the diameter of an end portion of the can body, said die having a plurality of annular relief grooves in its inner surface and a cylindrical land between adjacent relief grooves, each of said grooves having a depth of about 0.004 to 0.006 inch and a width of about 0.220 to 0.380 inch.

6. A method as set forth in claim 5 in which said metal can body is a drawn and ironed can body made of a medium or hard temper aluminum alloy.

7. A method as set forth in claim 5 which includes about 27 die necking operations each of which employs a die having annular relief grooves in their inner surfaces.

8. A die for necking the side wall of a metal can body having a plurality of annular relief grooves in the inner surface of the die in which said relief grooves are about 0.004 to 0.006 inch deep and about 0.220 to 0.380 inch wide.

9. A die as set forth in claim 8 in which said grooves are about 0.004 inch deep and about 0.310 inch wide.

10. A die as set forth in claim 8 which includes a cylindrical land between adjacent grooves.

11. A die as set forth in claim 8 in which said land is about 0.10 to 0.30 inch wide.

12. A die as set forth in claim 8 which includes 3–5 relief grooves.

13. A die as set forth in claim 11 in which said land is about 0.19 inch wide.

* * * * *